United States Patent [19]

Kelley et al.

[11] Patent Number: 4,657,518

[45] Date of Patent: Apr. 14, 1987

[54] MOTION DELAY MECHANISM FOR ANIMATED FIGURE TOY

[75] Inventors: William J. Kelley, Torrance; Mark Wittenberg, Anaheim, both of Calif.

[73] Assignee: Mattel, Inc., Hawthorne, Calif.

[21] Appl. No.: 797,589

[22] Filed: Nov. 13, 1985

[51] Int. Cl.[4] ..... A63H 13/00

[52] U.S. Cl. ..... 446/354; 185/39; 185/DIG. 1

[58] Field of Search ..... 446/354, 353, 352, 330, 446/309, 464, 336, 317, 296; 185/39, DIG. 1

[56] References Cited

U.S. PATENT DOCUMENTS

| | | | |
|---|---|---|---|
| 934,025 | 9/1909 | Steiff | 446/354 |
| 1,709,432 | 4/1929 | Hill | 446/371 |
| 3,264,779 | 8/1966 | Bonanno | 446/354 |
| 3,922,813 | 12/1975 | Terzian et al. | 446/354 |
| 4,530,672 | 7/1985 | Yoneda | 446/353 X |

*Primary Examiner*—Mickey Yu

*Attorney, Agent, or Firm*—Ronald M. Goldman; Melvin A. Klein; Daniel F. Sullivan

[57] ABSTRACT

A motion delay mechanism is disclosed which can be mounted within the torso of an animated figure toy having articulated arms. A spring is used to rotate the arms and a governor is incorporated into the mechanism for the purpose of delaying movement of the arms.

The governor features a worm gear which is used in conjunction with other gears to slow down rotation of the arms. A ratchet is used for selectively loading the spring and engaging the gears. The arms of the figure toy may be used to slowly move the hands of the toy through hair attached to the toy's head or to tilt the head backward.

7 Claims, 8 Drawing Figures

MOTION DELAY MECHANISM FOR ANIMATED FIGURE TOY

BACKGROUND OF THE INVENTION

The present invention relates generally to mechanisms used in animated figure toys and, more particularly to a mechanism used in an animated figure toy for the purpose of delaying movement of the arms of the toy in a controlled predetermined manner.

Toy figures having posable or movable articulated limbs are very popular with children. Some animated figure toys incorporate movable limbs such as arms which a child may move or position in order to increase play options. Spring-actuated mechanisms are typically used to facilitate movement of a toy's arms. Such a mechanism is shown and described in U.S. Pat, No. 3,264,779 issued to Bonanno on Aug. 9, 1966. This patent discloses the use of a coiled helical braking spring in combination with a torsion spring for the purpose of delaying movement of the arms of an animated toy. The helical braking spring impedes (delays) rotation of a shaft attached to the arms by contracting around a drum mounted on the shaft and frictionally slowing down rotation of the shaft.

Controlled, delayed movement of the arms of a figure toy may be better achieved by using a mechanism which incorporates a governor for accurately delaying movement of the arms. Since delayed movement of the arms of such a figure toy may be carefully controlled by the governor, additional play options are made available. The figure toy may be posed in different positions while the arms are slowly moved or used in conjunction with the toy's head. For example, one of the arms may be used to slowly move a hand of the toy through hair attached to the toy's head. Also, an arm may be controlled by the governor so that the toy's hand slowly moves upward and tilts back the head of the toy. This results in a particularly dramatic effect when the head of the figure toy is tilted back as the hand slowly passes through the toy's hair, increasing the enjoyment of the child playing with the toy. Accordingly, there is a need for a mechanism used in an animated figure toy which incorporates a governor for accurately delaying movement of the toy's arms in a controlled predetermined manner.

SUMMARY OF THE INVENTION

It is an object of this invention to provide an improved mechanism for delaying movement of at least one of the arms of a figure toy.

It is another object of this invention to provide an improved mechanism using a governor for accurately delaying movement of a figure toy's arms in a controlled predetermined manner.

It is still another object of this invention to provide an improved mechanism which allows the arms of a figure toy to be slowly moved upward and used in conjunction with the toy's head.

These and various objects and advantages are attained by a mechanism used in a figure toy having a torso and articulated arms comprising arm connector means rotatably mounted to said torso for operably engaging at least one of the arms of the figure toy; a shaft rotatably engaging the arm connector means; coupling means disposed about the shaft for transmitting torsion to and from the arm connector means; spring means for rotating the arm connector means; governor means for slowing rotating of the arm connector means; gear means for operably engaging the governor means to the coupling means; and ratchet means for selectively loading the spring means and engaging the gear means in order to engage the governor means to the coupling means.

The various features of the present invention will be best understood, together with further objects and advantages by reference to the following description taken in connection with the accompanying drawings.

DESCRIPTION OF THE INVENTION

Figure 1:
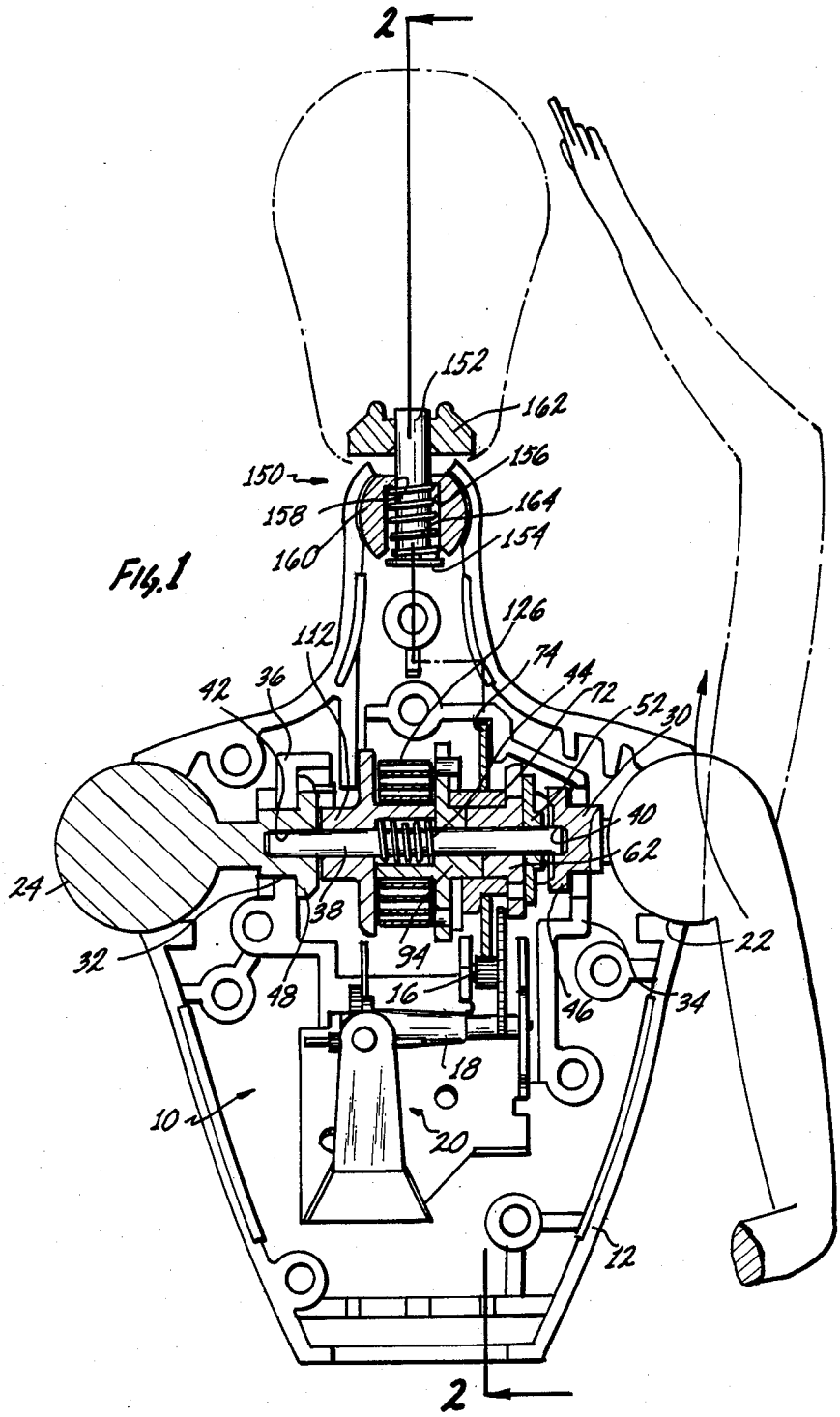
FIG. 1 is a front elevational view in partial cross section of a mechanism with a windmill governor shown mounted in a torso of a figure toy.
Figure 2:
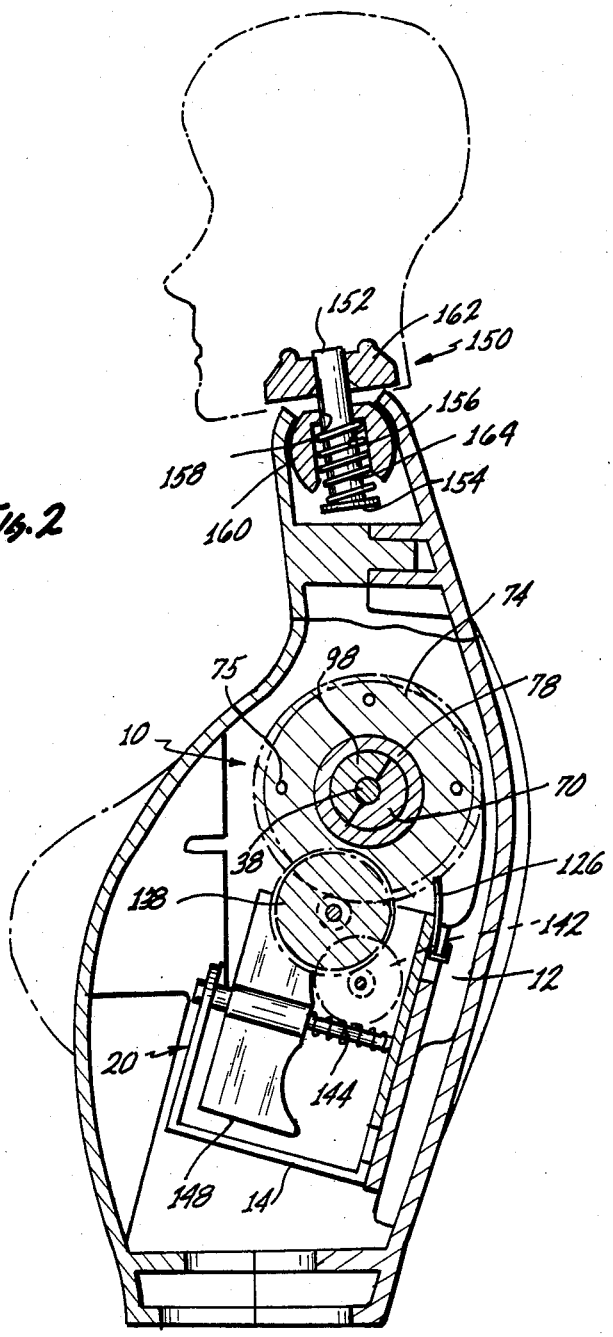
FIG. 2 is a side elevational view in partial cross section taken in the direction of arrows 2—2 shown in FIG. 1.

Referring now to the drawings, and particularly to FIGS. 1 and 2, there is shown a mechanism, generally designated 10, mounted in a torso 12 of a figure toy. The mechanism 10 includes a shaft-arm assembly (see FIGS. 3 and 4) and a supporting base member 14 with compound gears 16 and 18 and a windmill governor 20 rotatably mounted thereon (see FIGS. 5 and 6).

Looking first at the shaft-arm assembly, the arms of the figure toy (only one arm is shown in FIG. 1) are coupled to two arm connectors 22 and 24. The arms are preferably rotatably coupled to the arm connectors 22 and 24 at points 26 and 28, respectively (see FIG. 3). The arm connectors 22 and 24 have cylindrically-shaped members 30 and 32 extending therefrom. The cylindrically-shaped members 30 and 32 are rotatably mounted in supporting webs 34 and 36, respectively, connected to the torso 12 as shown in FIG. 1. A shaft 38 rotatably engages cylindrical bores 40 and 42 in the cylindrically-shaped members 30 and 32, respectively (see FIG. 1). As explained later, a spring 44 coiled around the shaft 38 as shown in FIG. 1 urges flanged portions 46 and 48 of the cylindrically-shaped members 30 and 32, respectively, against the supporting webs 34 and 36.

Figure 3:
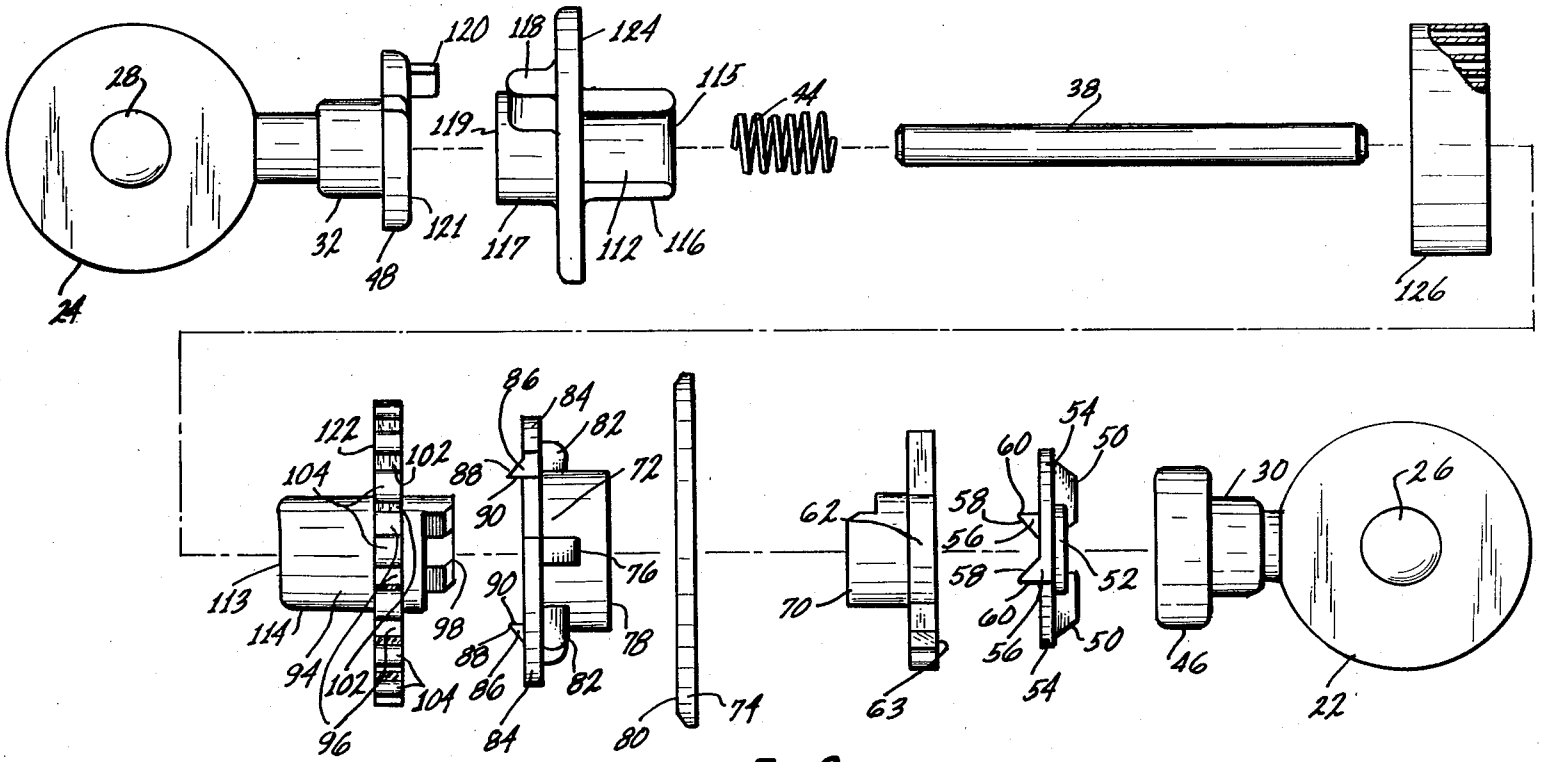
FIG. 3 is an enlarged exploded front elevational view of a shaft-arm assembly used in the mechanism.

FIG. 3 shows an exploded view of the shaft-arm assembly. Apertures (not shown) in the flanged portion 46 of cylindrically-shaped member 30 operably engage extensions 50 of a drive ratchet 52 when assembled so that rotation of the arm connector 22 causes the ratchet 52 to rotate. The drive ratchet 52 has an aperture 51 (see FIG. 4) through which the shaft 38 passes before engaging the cylindrical bore 40 in member 30. Two flexible arms 54 with angled extensions 56 are formed, molded or machined as integral parts of the drive ratchet 52. The angled extensions 56 have slanted sides 58 and straight sides 60 as shown in FIG. 3.

When assembled, the angled extensions 56 operably engage a drive detent 62 so that rotation of the drive ratchet 52 in a first direction (counterclockwise direction around the longitudinal axis of the assembly shown in FIG. 3) will cause the drive detent 62 to rotate in the first direction when the angled extensions 56 engage slots 64 (see FIG. 4) formed by radial extensions 61 of the drive detent 62. When the drive ratchet 52 is rotated in a second direction (clockwise direction) opposite the first direction, the slanted sides 58 will come into contact with sides 66 of the radial extensions 61 (see FIG. 4) of the drive detent 62. However since sides 58 are slanted and arms 54 are flexible, the arms 54 will bend allowing sides 58 to slip past sides 66 when sufficient torque is applied to the drive ratchet 52 relative to the drive detent 63. Thus, rotation of the drive ratchet 52 in the first direction causes the drive detent 62 to rotate in that directon while rotation of the drive ratchet 52 in the opposition direction will cause sides 58 to slip past sides 66 when sufficient torque is applied.

When assembled, a spring ratchet 72 is coupled to an upper drive gear 74 by a plurality of pinned extensions 76 (only one of the extensions 76 is shown in FIG. 3) which engage apertures 75 (see FIG. 4) in the gear 74. A cylindrical extension 78 of the spring ratchet 72 passes through a circular aperture 77 (see FIG. 4) in the drive gear 74 so that side 80 of the gear rests against radial ribs 82 which support flexible arms 84 of the spring ratchet 72. The flexible arms 84 have angled extensions 86 with slanted and straight sides 88 and 90, respectively. A cylindrical bore 92 passes through the spring ratchet as shown in FIG. 4.

The drive detent 62 is assembled by inserting extended portion 70 into aperture 92 in the spring ratchet 72 until it operably engages extended portion 98 of an arbor with detents 94 which is also inserted into aperture 92. Portions 70 and 98 operably engage (couple) each other so that any torgue applied to the drive detent 62 causes the arbor with detents 94 to rotate. In addition, the drive detent 62 and arbor with detents 94 operably engage each other and the spring ratchet 72 in such a way that the angled extensions 86 engage slots 96 formed by radial extensions 104 at the outer periphery of a disk-shaped portion 100 (see FIG. 4) of the arbor with detents. As a result, rotation of the spring ratchet 72 and upper drive gear 74 is controlled by the angled extensions 86. In other words, as the arbor with detents 94 is rotated in a counterclockwise direction around the longitudinal axis of the assembly shown in FIG. 3 by torque applied through the drive detent 62, slanted sides 88 of the ratchet come into contact with sides 102 of the radial extensions 104 (see FIG. 4) of the arbor with detents 94. If sufficient torque is applied, flexible arms 84 will bend and sides 88 will slide past sides 102. However, if the arbor with detents 94 rotates in the opposite direction (clockwise direction), then the angled extensions 86 will engage the slots 96 causing the spring ratchet 72 and upper drive gear 74 to rotate in the same direction.

Apertures 106 and 108 (see FIG. 4) pass through the arbor with detents 94 and drive detent 62, respectively, in the direction of the longitudinal axis of the assembly shown in FIG. 3. When assembled, one end of the shaft 38 passes through the apertures 106 and 108. The other end of the shaft 38 passes through an aperture 110 (see FIG. 4) in an arbor with stop 112 before engaging the cylindrical bore 42 (see FIG. 1) in cylindrical-shaped member 32.

Figure 4:
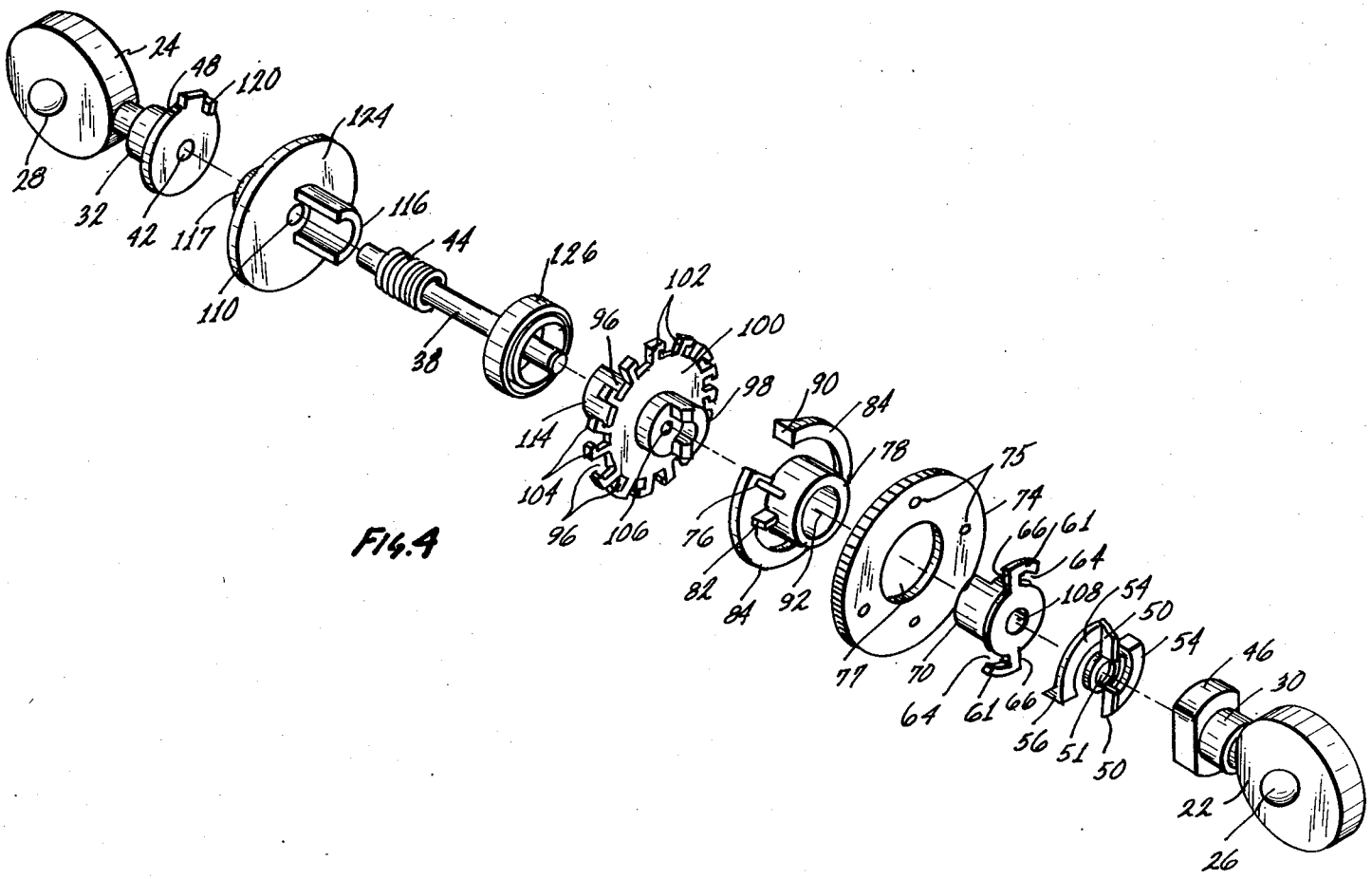
FIG. 4 is an enlarged exploded perspective view of the shaft-arm assembly.

The arbor with detents 94 and arbor with stop 112 have extensions 114 and 116, respectively, which preferably configure a half-cylinder (see FIG. 4). When assembled, end 113 of extension 114 contacts side 124 of the arbor with stop 112 and end 115 of extension 116 contacts side 122 of the arbor with detents 94. In addition, extensions 114 and 116 operably engage (couple) each other in such a way that torque is transferred from the arbor with detents 94 to the arbor with stop 112 or vice versa. A stop 118 is formed, molded or machined as part of the arbor with stop 112 (see FIG. 3). Likewise, a tab 120 extending from flange 48 as shown in FIGS. 3 and 4 is formed, molded or machined as part of the arm connector 24. Thus, when stop 118 comes into contact with tab 120, torque is transferred from the arbor with stop 112 to the arm connector 24 or vice versa.

As assembled, the shaft 38 passes through apertures in the drive ratchet 52, drive detent 62, arbor with detents 94 and arbor with stop 112 with the ends of the shaft 38 rotatably engaging bores 40 and 42 in members 30 and 32. In addition, spring 44 is assembled around shaft 38 as shown in FIGS. 1 and 4. Spring 44 fits inside extensions 114 and 116 and contacts sides 122 and 124 (see FIG. 3) so that the arbor with detents 94 and arbor with stop 112 are urged toward arm connectors 22 and 24, respectively. As a result, side 119 of an extended portion 117 of the arbor with stop 112 is urged against side 121 of flange 48. Likewise, extended portion 98 is urged against extended portion 70 and side 63 of the drive detent 62 is urged against the drive ratchet 52. Thus, flanges 46 and 48 are urged against supporting webs 34 and 36 (see FIG. 1) by spring 44.

A flat steel spring 126 is assembled around the extensions 114 and 116 as shown in FIG. 1. One end of the spring 126 may be attached to either extension 114 or 116 while the other end is attached to the torso 12 (see FIG. 2). Counterclockwise rotation about the axis of the assembly would coil the spring 126 building up tension in the spring. Conversely, clockwise rotation would uncoil the spring 126.

Figure 6:
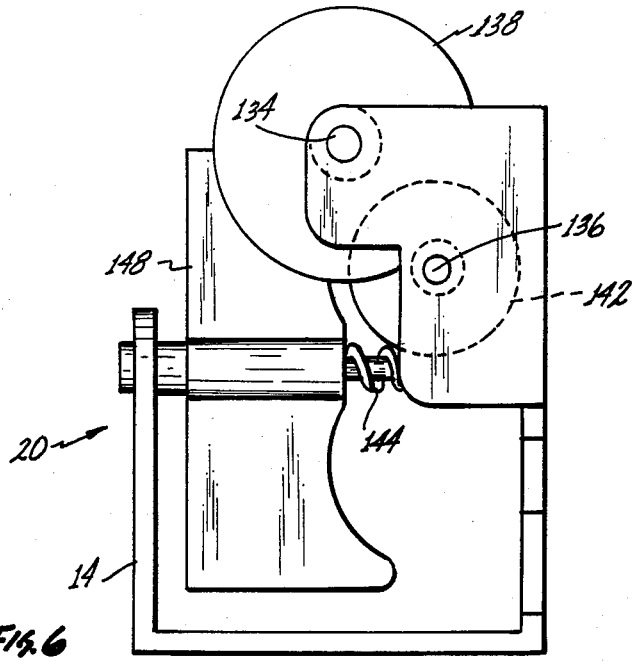
FIG. 6 is a side elevational view of the supporting base members shown in FIG. 5.
Figure 5:
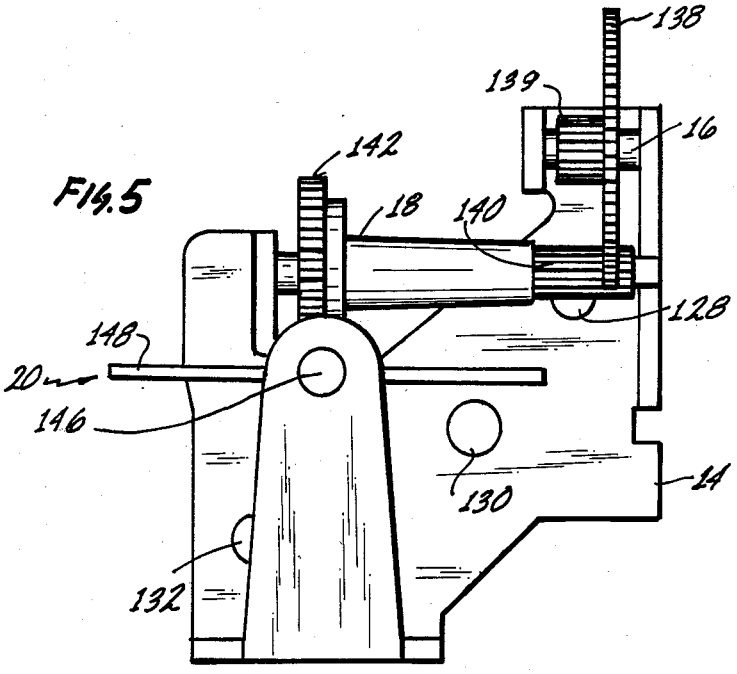
FIG. 5 is an enlarged front elevational view of a supporting base member with gears and a windmill governor mounted on the base member.

FIGS. 5 and 6 show compound gears 16 and 18 and the windmill governor 20 rotatably mounted on the supporting base member 14. The supporting base member 14 may be mounted on the torso 12 by any convenient manner such as by fasteners at points 128, 130 and 132 shown in FIG. 5. Gears 16 and 18 are rotatably mounted to the supporting base member 14 at 134 and 136, respectively, as shown in FIG. 6. Gear 16 has a first lower driven gear 138 which engages pinion gear 140 of gear 18 as shown in FIG. 5. When assembled, pinion gear 139 of gear 16 engages the upper drive gear 74. Gear 18 has a second lower driven gear 142 which engages a worm screw 144 used as part of the governor 20. The worm screw 144 is rotatably mounted to the supporting base member 14 at 146 as shown in FIG. 5 Fastened to the worm screw 144 is a rotating vane 148 which rotates as the worm screw 144 turns. The worm screw 144 is designed so that it will turn in only one direction or only when lower driven gear 142 rotates in a clockwise direction about 136.

After the mechanism 10 is assembled as shown in FIG. 1, it will operate as follows. Arm connector 22 may be rotated in a counterclockwise direction about the longitudinal axis of the assembly shown in FIG. 3 resulting in downward rotation of the arm of the figure toy coupled to the arm connector. When torqued in this manner, the angled extensions 56 of the drive ratchet 52 will engage slots 64 of the drive detent 62 causing the detent to rotate. The drive detent 62 will then cause the arbor with detents 94 to rotate in the same direction since extended portions 70 and 98 are coupled together. Since the worm screw 144 is designed to resist movement of the lower drive gear 142 in a counterclockwise direction, rotation of the upper drive gear 74 in the counterclockwise direction will also be resisted by the worm screw 144 when the mechanism is assembled as shown in FIG. 1. This resistance causes slanted sides 88 of the spring ratchet 72 to slip past sides 102 (as arms 84 bend) so long as a counterclockwise torque is applied to the arbor with detents.

Continued torquing of the arbor with detents 94 will cause the spring 126 to coil building up tension in the spring. When the arm connector 22 is released, the spring will uncoil causing the arbor with detents 94 to rotate in the opposite direction (clockwise direction). As the arbor with detents 94 rotates in the clockwise direction, slots 96 of the arbor will engage angled extensions 86 of the spring ratchet 72 causing the ratchet and upper drive gear 74 to rotate in the clockwise direction. Gear 74 then engages pinion gear 139 which causes lower driven gear 138 to rotate in a counterclockwise direction. Likewise, lower driven gear 138 engages pinion gear 140 which causes lower driven gear 142 to rotate in a clockwise direction. As a result, lower driven gear 142 forces the worm screw 144 to rotate. This, in turn, causes the vane 148 to rotate. As the vane 148 rotates, it slows down rotation of the gears and arm connector 22 and upward rotation of the arm of the figure toy coupled to the arm connector (see arm represented by dashed lines in FIG. 1). Thus, since the windmill governor 20 can be designed to slow down rotation as desired, upward rotation of the arms of a figure toy can be carefully controlled in a predetermined manner. As such, the spring ratchet 72 and the arbor with detents 94 function as a ratchet means for selectively engaging the gear to allow the governor to slow the rotation of the arm.

Since extensions 114 and 116 are coupled together, the uncoiling spring 126 also causes arm connector 24 to slowly rotate when stop 118 comes into contact with tab 120. Therefore, upward rotation of both arms of a figure toy may be carefully controlled by the governor 20 if desired.

The drive ratchet 52 is incorporated into the mechanism 10 in order to prevent damage by a child who rotates arm connector 22 in the wrong direction. If the child rotates arm connector 22 in a clockwise direction, then the spring 126 will furnish sufficient resistance to cause flexible arms 54 to bend and slanted sides 58 to slip past sides 66. As such, the drive ratchet 52 and drive detent 62 function as a drive means for selectively engaging and disengaging the arm connector 22. In addition, the flexibility of spring 44 in the direction of the axis of the assembly shown in FIG. 3 will facilitate slippage of sides 58. However, any other means of safeguarding against a child turning the arm connector in the wrong direction may be used instead of a drive ratchet such as a one-way clutch or spring mechanism without departing from the spirit and scope of the invention.

FIGS. 1 and 2 show a spring-loaded neck plug 150 used to assemble the head of the figure toy (shown by dashed lines) to the upper neck portion of the torso 12. The plug 150 has an elongated member 152 with a head 154 at one end. The other end of the plug 150 passes through large and small apertures 156 and 158, respectively, in a ball member 160 which is free to frictionally rotate in the upper neck portion as shown in FIGS. 1 and 2. The end of the elongated member 150 which passes through aperture 158 is attached to member 162 which is coupled to the head of the figure toy. A spring 164 is trapped in aperture 156 between the head 154 of the elongated member 152 and an annular surface existing where apertures 156 and 158 communicate with each other. Spring 164 is compressed when assembled so that the spring-loaded neck plug 150 holds the figure toy's head in any desired position but still allows the ball member 160 to be frictionally rotated in the upper neck portion in order to change the position of the head.

Use of the spring-loaded neck plug 150 allows the head of the figure toy to be used in conjunction with the arms of the toy. For example, the head of the figure toy may be tilted slightly forward and held in place by means of the spring-loaded neck plug 150. The arms of the figure toy may then be rotated downward and released to move slowly upward under the influence of the delaying mechanism 10 until the toy's hands slowly brush through the figure toy's hair and tilt the head backward. The spring-loaded neck plug 150 allows the head (or ball member 160) to frictionally rotate backward under the action of the arms.

Figure 8:
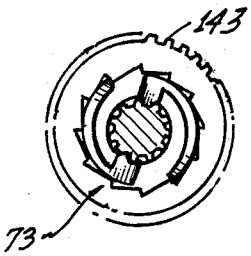
FIG. 8 is an enlarged cross sectional view of the lower driven gear taken in the direction of arrows 8—8 shown in FIG. 7.
Figure 7:
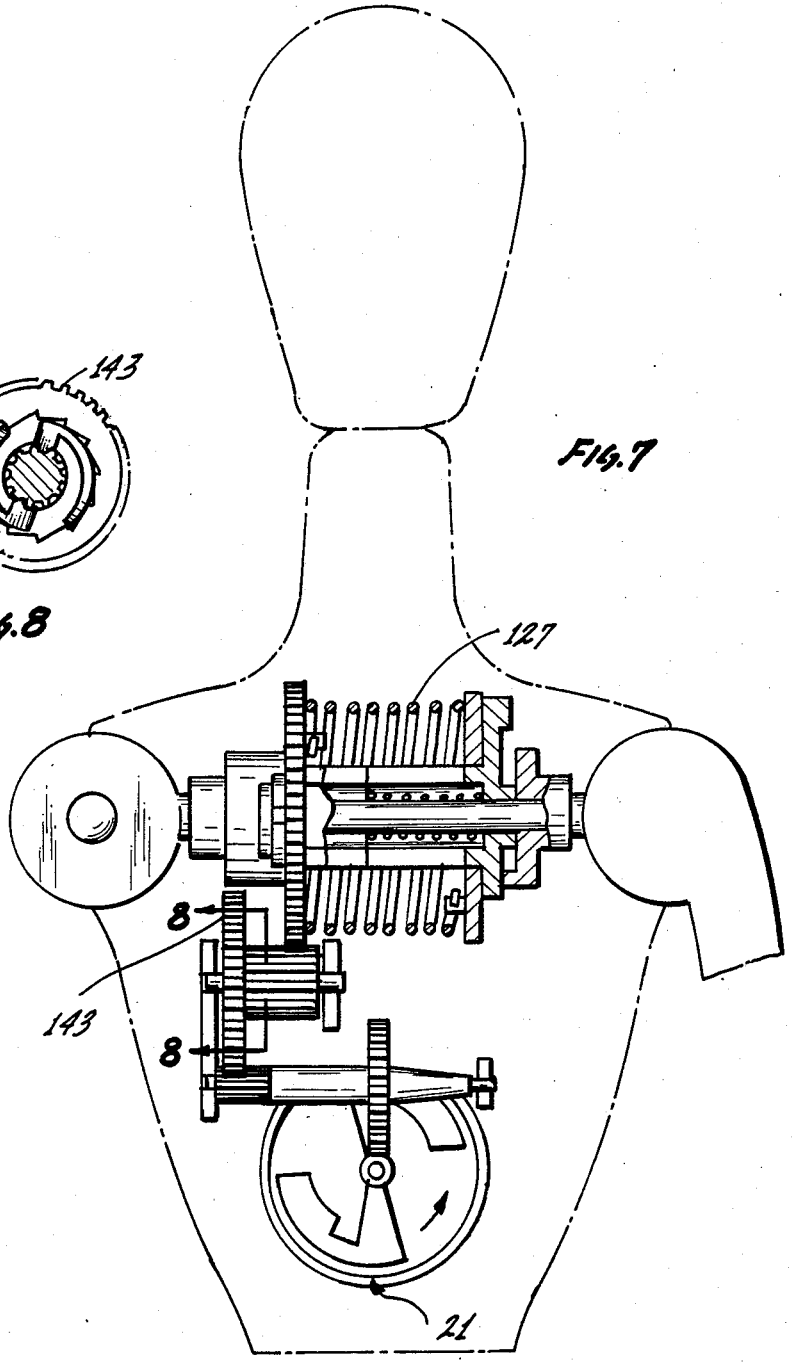
FIG. 7 is a front elevational view in partial cross section of a mechanism with a centrifugal governor and a lower driven gear incorporating a ratchet.

Persons of ordinary skill in the toy field are capable of numerous modifications once taught the above principles. Accordingly, it will be understood by those skilled in the art that changes in form and detail may be made to the above-described invention without departing from the spirit and scope of the invention such as those changes shown in FIGS. 7 and 8. The mechanism shown in FIGS. 7 and 8 uses a centrifugal governor 21 instead of a windmill governor, a coil spring 127 instead of a flat steel spring and incorporates a ratchet 73 into a lower driven gear 143, all as shown in FIGS. 7 and 8. The centrifugal governor may be similar to that manufactured by Sankyo Seiki Manufacturing Company, Ltd., Tokyo, Japan.

We claim:

1. A motion delay mechanism for a figure toy having a torso and articulated arms, comprising:

a first arm connector rotatably mounted to a supporting web attached to said torso, said first arm connector being coupled to one of said articulated arms and having an aperture passing partially therethrough;

a drive ratchet operably coupled to said first arm connector, said drive ratchet having flexible arms with angled extensions and an aperture passing therethrough;

a drive detent operably coupled to said drive ratchet so that said angled extensions of said drive ratchet operably engage slots in said drive detent, said drive detent having an aperture passing therethrough and an extended portion;

a spring ratchet having an aperture passing therethrough, a plurality of pins, a cylindrical extension and flexible arms with angled extensions, said extended portion of said drive detent operably engaging said aperture of said spring ratchet;

an upper drive gear having a large aperture passing therethrough and a plurality of smaller apertures, said cylindrical extension of said spring ratchet operably engaging said large aperture and said plurality of pins of said spring ratchet operably engaging said plurality of smaller apertures;

an arbor with detents having an aperture passing therethrough, a disk-shaped portion with a plurality of slots, a first extension generally configured as a half-cylinder and a second extension, said second extension operably engaging said aperture in said spring ratchet and said extended portion of said drive detent, said angled extensions of said spring ratchet operably engaging said plurality of slots of said disk-shaped portion;

an arbor with stop having an aperture passing therethrough, an extension generally configured as a half-cylinder and a stop, said extension of said arbor with stop operably engaging said first extension of said arbor with detents;

a second arm connector rotatably mounted to another supporting web attached to said torso, said second arm connector being coupled to the other of said articulated arms and having an aperture passing partially therethrough and a tab operably engaging said stop of said arbor with stop;

a shaft rotatably engaging said apertures in said first and second arm connectors and passing through said apertures of said drive ratchet, said drive detent, said spring ratchet, said arbor with detents and said arbor with stop;

a first spring coiled around said shaft inside said first extension of said arbor with detents and said extension of said arbor with stop;

a second spring coiled around said first extension of said arbor with detents and said extension of said arbor with stop, one end of said second spring being attached to said torso;

a first compound gear rotatably mounted to a support base member attached to said torso, said first compound gear including a lower driven gear and a pinion gear operably engaging said upper drive gear;

a second compound gear rotatably mounted to said support base member, said second compound gear including a lower driven gear and a pinion gear operably engaging said lower driven gear of said first compound gear; and a governor including a worm gear rotatably mounted to said support base member and a rotating vane attached to said worm gear, said worm gear operably engaging said lower driven gear of said second compound gear.

2. The mechanism of claim 1 further comprising a spring-loaded neck plug including:

a ball member operably engaging an upper neck portion of said torso;

an elongated member engaging large and small apertures in said ball member, said elongated member having a head at one end thereof;

a spring held in said large aperture of said ball member by said head of said elongated member; and a member coupled to a head of said figure toy and coupled to the other end of said elongated member.

3. A motion delay mechanism for a figure toy having a torso and articulated arms, comprising:

arm connector means rotatably mounted to said torso for operably engaging at least one of said arms of said figure toy;

a shaft rotatably engaging said arm connector means;

coupling means disposed about said shaft for transmitting torsion to and from said arm connector means, said coupling means including drive means for selectively engaging and disengaging said arm connector means;

first sprng means disposed about said shaft for biasing said drive means toward said arm connector means;

second spring means for rotating said arm connector means;

governor means for slowing rotation of said arm connector means;

gear means for operably engaging said governor means to said coupling means; and ratchet means for selectively engaging said gear means in order to engage said governor means to said coupling means.

4. The mechanism of claim 3 wherein said gear means comprises:

an upper drive gear disposed around said shaft;

a first compound gear including a lower driven gear and a pinion gear operably engaging said upper drive gear; and a second compound gear including a lower driven gear operably engaging said governor means and a pinion gear operably engaging said lower driven gear of said first compound gear.

5. The combination of claim 4 wherein said governor means comprises a worm gear operably engaging said lower driven gear of said second compound gear and a rotating vane attached to said worm gear.

6. The mechanism of claim 5 further comprising spring-loaded neck plug means for operably coupling a head of said figure toy to an upper neck portion of said torso and allowing said head to be frictionally moved by at least one of said arms with respect to said upper neck portion.

7. The mechanism of claim 3 wherein said arm connector means comprises two arm connectors, each of said arm connectors coupled to one of said arms of said figure toy.

* * * * *